US008948685B2

(12) United States Patent
Mankaruse et al.

(10) Patent No.: US 8,948,685 B2
(45) Date of Patent: Feb. 3, 2015

(54) MOBILE WIRELESS COMMUNICATIONS DEVICE USING WIRED HEADSET AS AN ANTENNA AND RELATED METHODS

(75) Inventors: George Soliman Mankaruse, Kitchener (CA); George Shaker, Waterloo (CA); Jens Kristian Poulsen, Kitchener (CA); Nagula Tharma Sangary, Waterloo (CA); Perry Jarmuszewski, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 480 days.

(21) Appl. No.: 13/345,109

(22) Filed: Jan. 6, 2012

(65) Prior Publication Data

US 2013/0178149 A1 Jul. 11, 2013

(51) Int. Cl.
*H04H 40/18* (2008.01)

(52) U.S. Cl.
USPC ..... 455/3.06

(58) Field of Classification Search
None
See application file for complete search history.

(56) References Cited

U.S. PATENT DOCUMENTS

| | | | | |
|---|---|---|---|---|
| 5,991,637 | A | 11/1999 | Mack, II et al. | |
| 6,032,064 | A * | 2/2000 | Devlin et al. | 600/383 |
| 6,236,969 | B1 | 5/2001 | Ruppert et al. | 704/275 |
| 6,394,953 | B1 * | 5/2002 | Devlin et al. | 600/383 |
| 7,119,750 | B2 | 10/2006 | Kinney et al. | 343/702 |
| 7,515,944 | B2 | 4/2009 | Zhu et al. | 455/569.1 |
| 7,656,353 | B2 * | 2/2010 | Qi et al. | 343/702 |
| 8,063,836 | B2 * | 11/2011 | Qi et al. | 343/702 |
| 8,150,046 | B2 | 4/2012 | Hansson et al. | |
| 8,831,234 | B2 * | 9/2014 | Turner et al. | 381/58 |
| 2005/0053243 | A1 * | 3/2005 | Ganton | 381/58 |
| 2007/0120745 | A1 * | 5/2007 | Qi et al. | 343/702 |
| 2008/0167087 | A1 | 7/2008 | Tang et al. | 455/569.1 |
| 2009/0033574 | A1 | 2/2009 | Hung | 343/718 |
| 2009/0180630 | A1 * | 7/2009 | Sander et al. | 381/58 |
| 2010/0069114 | A1 * | 3/2010 | Lee et al. | 455/556.1 |
| 2010/0094552 | A1 * | 4/2010 | Qi et al. | 701/213 |
| 2010/0215183 | A1 | 8/2010 | Hansson et al. | 381/58 |

(Continued)

FOREIGN PATENT DOCUMENTS

| | | |
|---|---|---|
| EP | 2613407 A1 | 7/2013 |
| GB | 2358990 | 8/2001 |
| GB | 2380861 | 8/2005 |

OTHER PUBLICATIONS

"Cell phones 4-pole headset pinout," Pinouts Guide.com, 4 pages, 2011.

(Continued)

*Primary Examiner* — Bobbak Safaipour
(74) *Attorney, Agent, or Firm* — Allen, Dyer, Doppelt, Milbrath & Gilchrist, P.A. Attorneys at Law

(57) ABSTRACT

A mobile wireless communications device may include a housing, and circuitry carried by the housing. The circuitry may include a wireless transceiver, a wireless broadcast receiver, audio circuitry coupled to the wireless transceiver and the wireless broadcast receiver, a wired headset jack, and a reference voltage device line, and at least one wired headset device line coupled between the audio circuitry and the wired headset jack. The reference voltage device line may be also coupled to the wireless broadcast receiver so that a corresponding reference voltage headset line of a wired headset serves as an antenna for the wireless broadcast receiver. The reference voltage line may be switchable to one or more connectors at the headset jack.

30 Claims, 5 Drawing Sheets

(56) References Cited

U.S. PATENT DOCUMENTS

| | | | | |
|---|---|---|---|---|
| 2010/0279734 | A1 | 11/2010 | Karkinen et al. | 455/554.2 |
| 2011/0002496 | A1 | 1/2011 | Meesters | 381/370 |
| 2011/0045789 | A1 | 2/2011 | Sinton et al. | 455/127.1 |
| 2012/0064943 | A1* | 3/2012 | Qi et al. | 455/550.1 |
| 2012/0134503 | A1 | 5/2012 | Poulsen et al. | |
| 2012/0215467 | A1 | 8/2012 | Poulsen | |
| 2013/0044892 | A1* | 2/2013 | Lafky et al. | 381/74 |

OTHER PUBLICATIONS

"Motorola Talkabout headset pinout," Pinouts Guide.com, 2 pages, 2010.

European Search Report for EP Application No. 12150411.2 dated Jun. 29, 2012, 5 pages.

Response to European Search Report for EP Application No. 12150411.2 dated Oct. 31, 2012, 13 pages.

* cited by examiner

MOBILE WIRELESS COMMUNICATIONS DEVICE USING WIRED HEADSET AS AN ANTENNA AND RELATED METHODS

TECHNICAL FIELD

This application relates to the field of communications, and more particularly, to wireless communication systems and related methods.

BACKGROUND

Mobile communications devices have become an integral part of society over the last two decades. Indeed, more than eighty-two percent of Americans own a mobile communications device, for example, a cell phone device. Even further, international cell phone device penetration has reached 3.3 billion units. In other words, approximately half the world's population has a cell phone device. The typical cell phone device includes an antenna, and a transceiver coupled to the antenna. The transceiver and the antenna cooperate to transmit and receive communications signals with a network infrastructure, usually maintained by a cell phone provider. Although the first cell phone devices typically included only voice or limited short message service capabilities, the capabilities of cell phone devices have increased greatly over the last decade.

One desirable cell phone device feature is an integrated broadcast radio receiver, such as a frequency modulation (FM) radio receiver and an amplitude modulation (AM) radio receiver. Due to the size constraints of typical cell phones, it may be difficult to provide an effective internal broadcast radio antenna. An external broadcast radio antenna may be effective, but may reduce the aesthetic appeal of the cell phone device. Once approach to this drawback may include utilizing a typical wired headset, i.e. headphones, as the broadcast radio antenna. The typical wired headset includes a plurality of lines, such as stereo audio output lines, a microphone line, a ground line, and a connector comprising a plurality of contact rings.

Depending on the manufacturing standard of the wired headset, the contact rings on the connector of the wired headset may have varying arrangements. Typical cell phone devices that use the wired headset as a broadcast radio antenna may specifically couple the wireless broadcast receiver to the audio signal line for that purpose. One drawback to this approach may include degraded voice quality, such as noise, echo or the requirement of additional external or internal filtering components.

DETAILED DESCRIPTION

Figure 1:
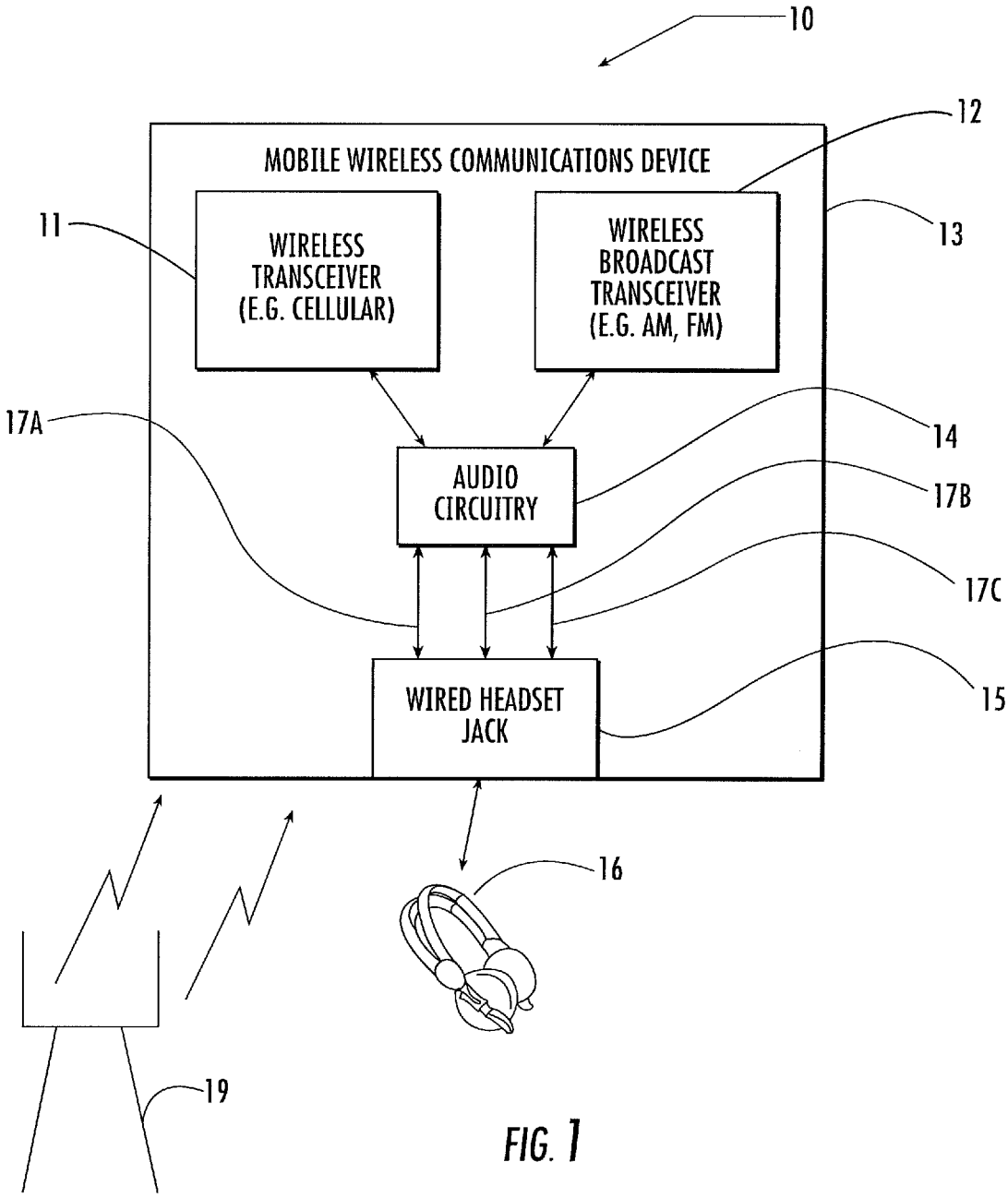
FIG. 1 is a schematic block diagram of an example embodiment of a mobile wireless communications device.

The present description is made with reference to the accompanying drawings, in which embodiments are shown.

However, many different embodiments may be used, and thus the description should not be construed as limited to the embodiments set forth herein. Rather, these embodiments are provided so that this disclosure will be thorough and complete. Like numbers refer to like elements throughout.

Generally speaking, a mobile wireless communications device may include a housing, and circuitry carried by the housing and comprising a wireless transceiver, a wireless broadcast receiver, audio circuitry coupled to the wireless transceiver and the wireless broadcast receiver, a wired headset jack, and a reference voltage device line (typically connected to system ground through an inductor), and at least one wired headset device line coupled between the audio circuitry and the wired headset jack. The reference voltage device line may be also coupled to the wireless broadcast receiver so that a corresponding reference voltage headset line of a wired headset serves as an antenna for the wireless broadcast receiver.

More specifically, the wired headset may be coupled to the wired headset jack and comprises a plurality of contacts, and a plurality of headset lines respectively coupled to the plurality of contacts. The plurality of contacts may comprise a reference voltage contact, and at least one wired headset line contact, and the plurality of headset lines may include the reference voltage headset line coupled to the reference voltage contact, and at least one wired headset audio line coupled to the at least one headset line contact.

In some embodiments, the circuitry may be configured to determine the reference voltage contact and to selectively couple the reference voltage device line to the reference voltage contact. The circuitry may be configured to determine the at least one wired headset line contact and to selectively couple the at least one wired headset device line to the at least one wired headset contact.

For example, the wired headset may comprise an audio input transducer, and an audio output transducer configured to provide audio input and output for the audio circuitry. The at least one wired headset audio line may comprise a plurality thereof comprising an input transducer signal line coupled to the input transducer, and an output transducer line coupled to the output transducer.

Additionally, the at least one wired headset audio line may comprise a plurality thereof comprising stereo audio channel lines. The wireless broadcast receiver may comprise at least one of an FM radio receiver and an AM radio receiver. The wireless transceiver may comprise a cellular transceiver.

Another aspect is directed to a method for making a mobile wireless communications device. The method may comprise providing a housing, coupling circuitry to be carried by the housing and comprising a wireless transceiver, a wireless broadcast receiver, audio circuitry coupled to the wireless transceiver and the wireless broadcast receiver, a wired headset jack, and a reference voltage device line, and at least one wired headset device line coupled between the audio circuitry and the wired headset jack. The method also may comprise coupling the reference voltage device line to the wireless broadcast receiver so that a corresponding reference voltage headset line of a wired headset serves as an antenna for the wireless broadcast receiver.

Yet another aspect is directed to a method of operating a mobile wireless communications device comprising a wireless transceiver, a wireless broadcast receiver, audio circuitry coupled to the wireless transceiver and the wireless broadcast receiver, a wired headset jack to be coupled to a wired headset, and a reference voltage device line coupled to the wireless broadcast receiver, and at least one wired headset device line coupled between the audio circuitry and the wired headset jack. The wired headset may comprise a reference voltage contact, and the method may comprise determining the reference voltage contact and selectively coupling the reference voltage device line to the reference voltage contact so that a corresponding reference voltage headset line of the wired headset serves as an antenna for the wireless broadcast receiver.

Figure 2:
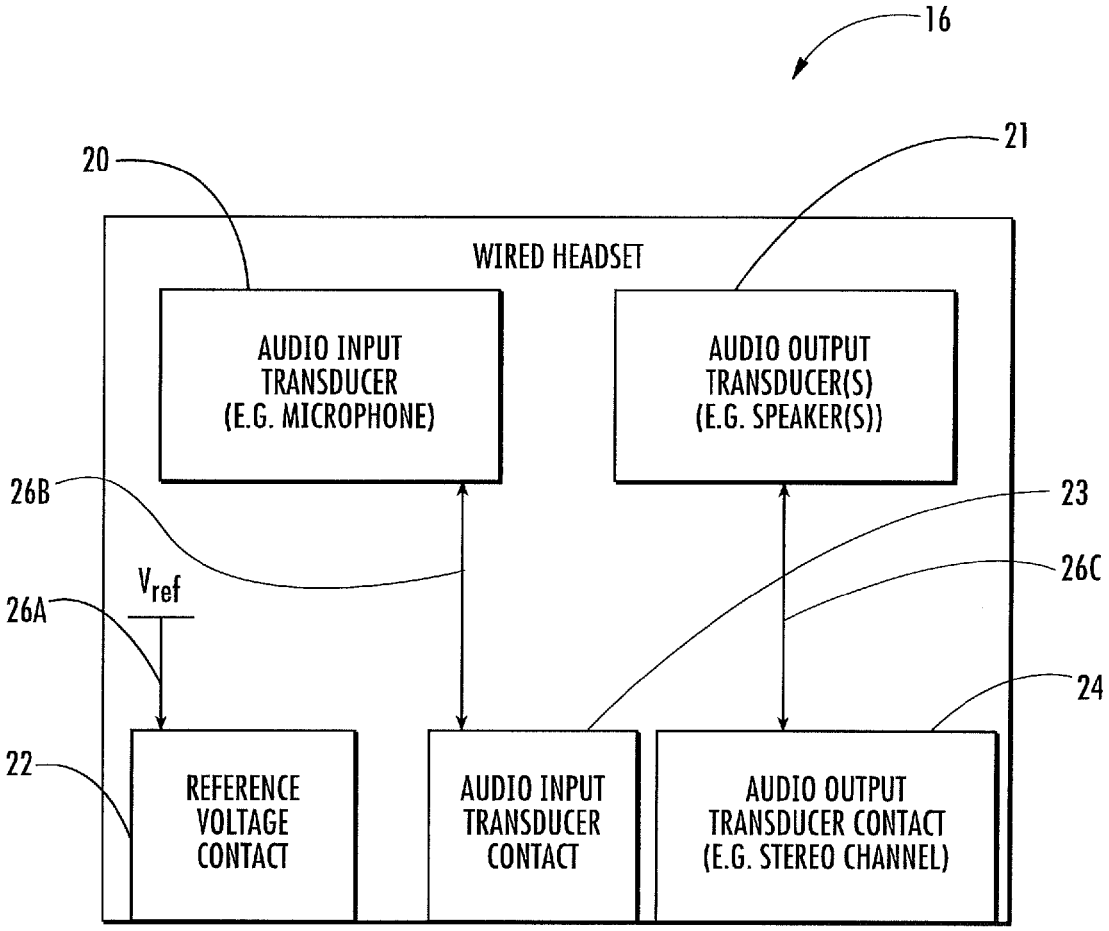
FIG. 2 is a schematic block diagram of the wired headset from the mobile wireless communications device of FIG. 1.
Figure 3:
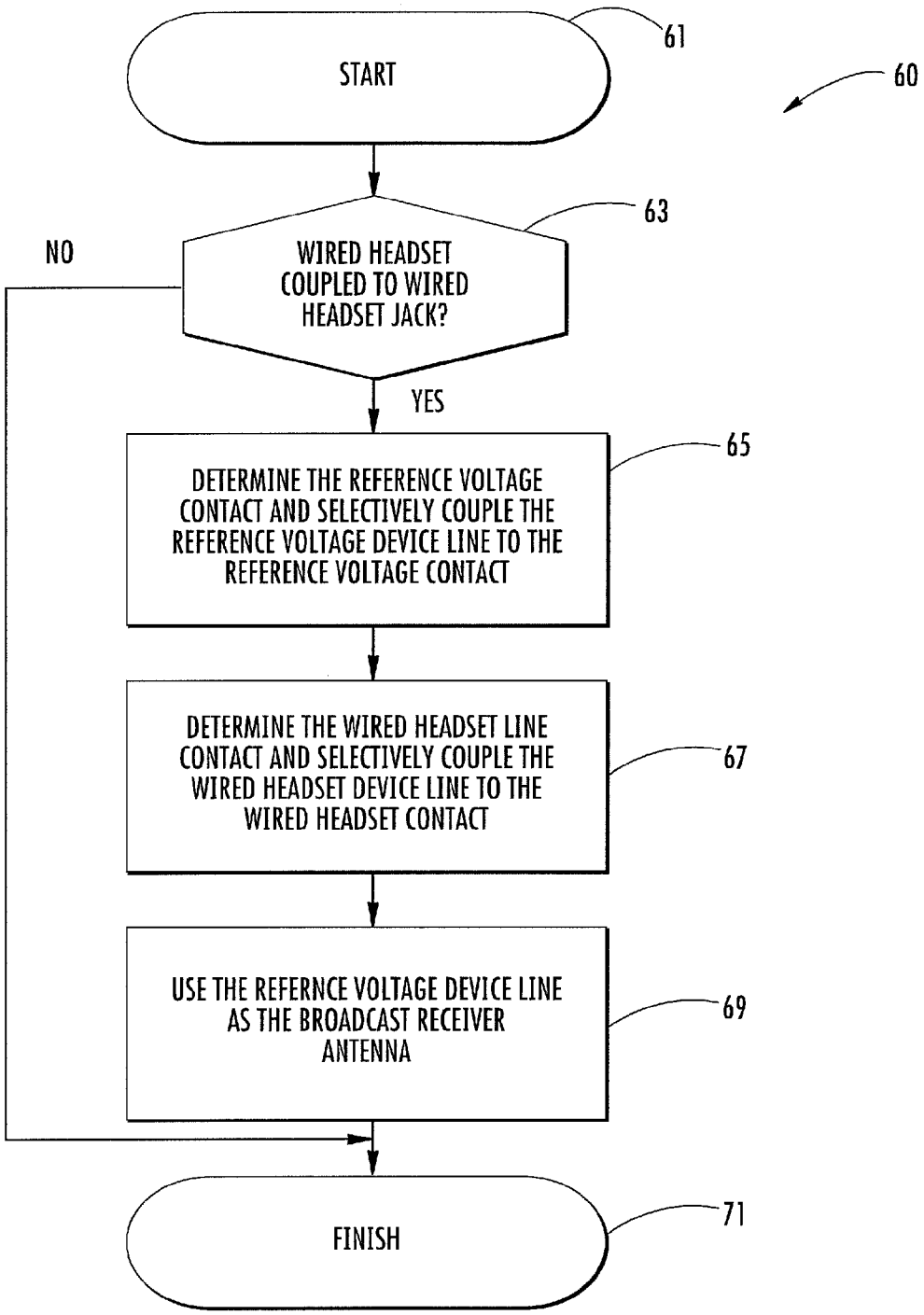
FIG. 3 is a flowchart illustrating operation of the mobile wireless communications device of FIG. 1.

Referring now to FIGS. 1-2, a mobile wireless communications device 10 according to the present disclosure is now described. Moreover, with reference additionally to FIG. 3, a flowchart 60 illustrates a method of operating the mobile wireless communications device 10 (Block 61). Example mobile wireless communications devices may include portable or personal media players (e.g., music or MP3 players, video players, etc.), remote controls (e.g., television or stereo remotes, etc.), portable gaming devices, portable or mobile telephones, smartphones, tablet computers, etc.

The mobile wireless communications device 10 illustratively includes a housing 13, and circuitry carried by the housing. The circuitry illustratively includes a wireless transceiver 11, and a wireless broadcast receiver 12. For example, the wireless broadcast receiver 12 may comprise at least one of an FM radio receiver, an AM radio receiver, and a television broadcast receiver, such as an ultra high frequency (UHF) or very high frequency (VHF) broadcast receiver. The wireless transceiver 11 may comprise a cellular transceiver, such as a transceiver based upon an Advanced Mobile Phone System (AMPS), time division multiple access (TDMA), code division multiple access (CDMA), Wideband code division multiple access (W-CDMA), personal communications service (PCS), GSM (Global System for Mobile Communications), enhanced data rates for GSM evolution (EDGE), etc. The wireless broadcast receiver 12 illustratively receives broadcast signals from a broadcast radio antenna 19.

The audio circuitry 14 is coupled to the wireless transceiver 11 and the wireless broadcast receiver 12. The audio circuitry 14 may comprise digital signal processing circuitry, such as noise canceling circuitry. The mobile wireless communications device 10 illustratively includes a wired headset jack 15. For example, the wired headset jack 15 may comprise a three terminal connector with labeling tip, ring, sleeve (TRS). For stereo headsets, a fourth terminal is necessary, and this TRRS connector will be labeled: tip, ring 1, ring 2, and sleeve. In other embodiments, the headset audio circuitry 14 may include low pass filters to remove RF before entering the audio sections.

The mobile wireless communications device 10 illustratively includes a reference voltage device line 17*a*, and a plurality of wired headset device lines 17*b*-17*c* coupled between the audio circuitry 14 and the wired headset jack 15. For example, the reference voltage device line 17*a* may comprise a ground line, and the plurality of wired headset device lines 17*b*-17*c* may comprise audio input and output lines.

More specifically, the wired headset 16 may be coupled to the wired headset jack 15 and comprises a plurality of contacts 22-24, and a plurality of headset lines 26*a*-26*c* respectively coupled to the plurality of contacts. The plurality of contacts 22-24 illustratively includes a reference voltage contact 22, an audio input transducer contact 23, and an audio output transducer contact 24.

In the illustrated embodiment, the wired headset 16 illustratively includes an audio input transducer 20 coupled to the audio input transducer contact 23, and an audio output transducer 21 coupled to the audio output transducer 21 and configured to provide audio input and output for the audio circuitry 14. The plurality of headset lines 26*a*-26*c* illustratively includes a reference voltage headset line 26*a* (e.g. an unshielded reference voltage headset line) coupled to the reference voltage contact 22, an input transducer signal line 26*b* coupled between the audio input transducer contact 23 and the audio input transducer 20, and an output transducer signal line 26*c* coupled between the audio output transducer contact 24 and the audio output transducer 21. In the illustrated embodiment, the wired headset 16 illustratively includes one audio output transducer contact 24 and one audio output transducer line 26*c*, i.e. a monochannel headset, but other embodiments may include a plurality of wired headset speaker line contacts and lines, i.e. a stereo channel headset.

In typical wired headsets, the arrangement of the various headset lines on the TRS/TRRS connector may be varied. For example, for one connector, the sleeve in the TRRS connector may be the ground line while in another TRRS connector, that sleeve contact may be coupled to a microphone line. Advantageously, the circuitry, in the illustrated embodiment, the audio circuitry 14, determines the arrangement of the plurality of contacts 22-24 in the TRS connector (not shown) of the wired headset 16. (Blocks 63, 65, & 67). In particular, the audio circuitry 14 is determining the TRS connector position of the reference voltage contact 22. Once the reference voltage contact 22 has been located, the audio circuitry 14 couples the reference voltage device line 17*a* to the wireless broadcast receiver 12 so that the corresponding reference voltage headset line 26*a* of a wired headset 16 serves as an antenna for the wireless broadcast receiver (Blocks 69 & 71).

Helpfully, the user can now connect any standard of wired headset to the wired headset jack 15 of the mobile wireless communications device 10, and the wireless broadcast receiver 12 is coupled to the wired headset line 26*a*-26*c* that provides best performance. More specifically, in the typical device, the audio input/output lines are used as an antenna for the wireless broadcast receiver, which may result in poor performance depending on the configuration. Moreover, the audio quality of these lines may be negatively impacted by the wireless broadcast receiver using these lines as an antenna or require extra filters. Advantageously, the reference voltage headset line 26*a* is not typically shielded, which provides for enhanced antenna receive characteristics.

Figure 4:
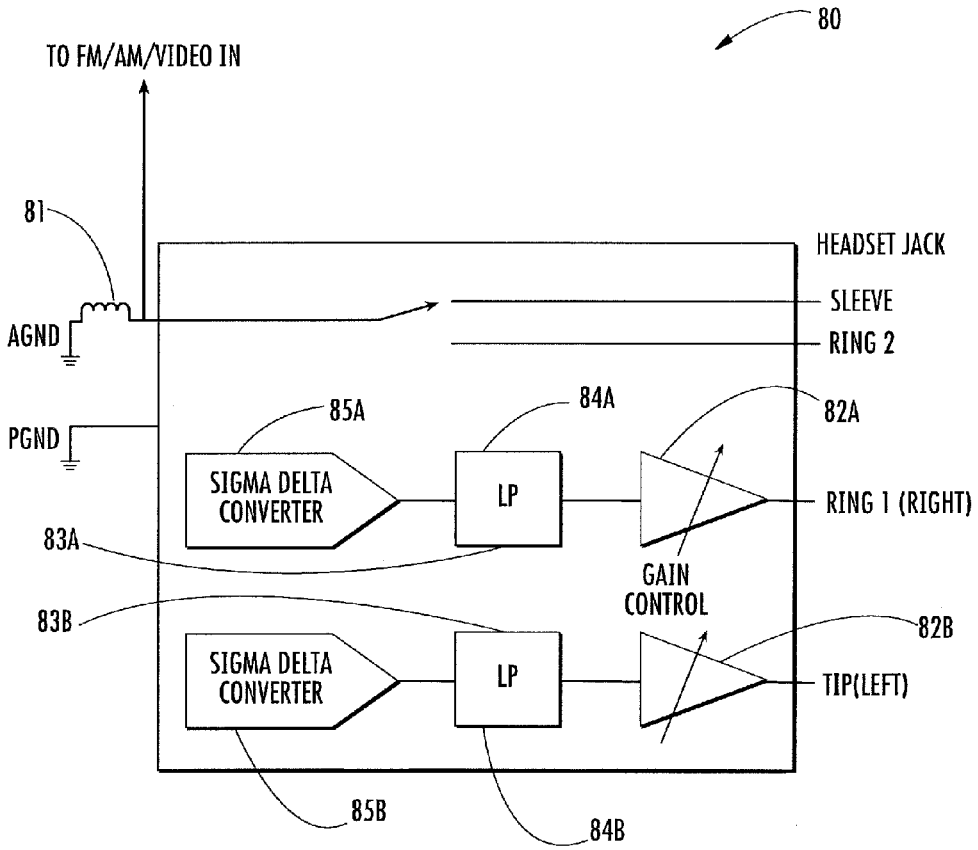
FIG. 4 is a schematic diagram of a coupling circuit in the mobile wireless communications device of FIG. 1.

Referring now additionally to FIG. 4, the mobile wireless communications device 10 may include a coupling circuit 80 between the wired headset jack 15 and the wired headset 16. The coupling circuit 80 typically includes an inductor 81 to serve as a DC block between the antenna and a ground or audio connection. In other embodiments, the headphone lines may serve as the receiving pins for a broadcast receiver, while the automatic configuration and switching of the ground terminal is still being included in the configuration. In other embodiments, the audio chip may include tuning circuits in order to enhance the signal-to-noise ratio of the received signal. This can be done by selectively adjusting a resonant circuit so that the resonance frequency matches the signal of interest. Also, it is possible to add the illustrated high frequency pre-amplifiers 82*a*-82*b* (such as a MOSFET or bipolar transistor) in order to boost the signal and thereby make the output less sensitive to noise inside the mobile phone. The coupling circuit 80 illustratively includes a pair of low pass filters 84*a*-84*b* upstream of the pre-amplifiers, and a pair of sigma delta converters 85*a*-85*b* upstream of the low pass filters.

Example components of a mobile wireless communications device 1000 that may be used in accordance with the above-described embodiments are further described below with reference to FIG. 5. The device 1000 illustratively includes a housing 1200, a keyboard or keypad 1400 and an output device 1600. The output device shown is a display 1600, which may comprise a full graphic liquid crystal display (LCD). Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400.

The housing 1200 may be elongated vertically, or may take on other sizes and shapes (including clamshell housing structures). The keypad may include a mode selection key, or other hardware or software for switching between text entry and telephony entry.

Figure 5:
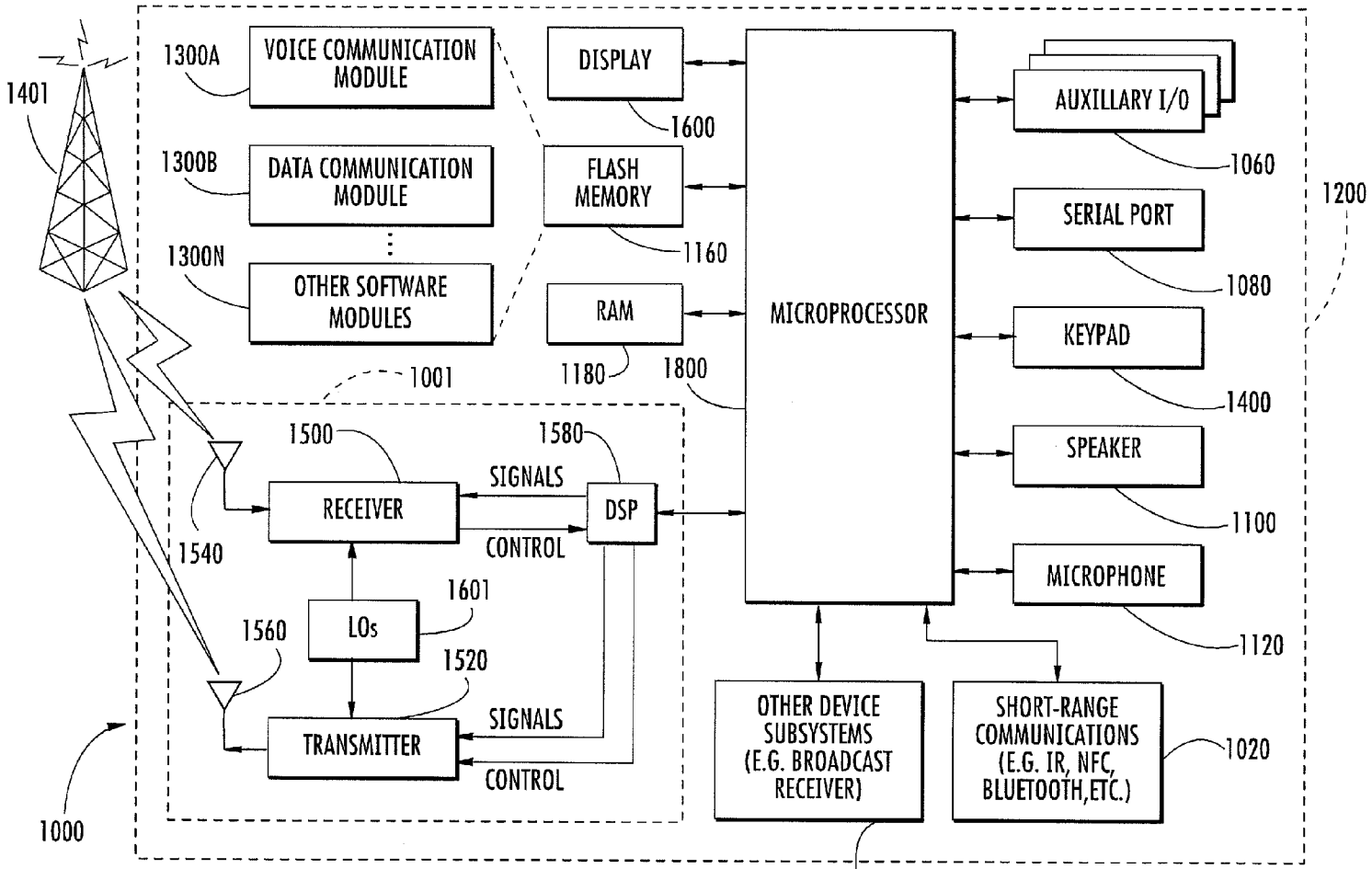
FIG. 5 is a schematic block diagram illustrating example components for the mobile wireless communications device of FIG. 1.

In addition to the processing device 1800, other parts of the mobile device 1000 are shown schematically in FIG. 5. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. These other device subsystems 1201 may include a broadcast receiver utilizing an internal antenna or an external accessory used as antenna. It may include the possibility of configuring the audio interface to be compatible with more than one type of pin-out depending of the accessory attached to the device. One or more of the connections from the accessory may be used as antenna utilized for broadcast reception of audio and/or video signals. The mobile device 1000 may comprise a two-way RF communications device having data and, optionally, voice communications capabilities. In addition, the mobile device 1000 may have the capability to communicate with other computer systems via the Internet.

Operating system software executed by the processing device 1800 is stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with corresponding data items stored or associated with a host computer system.

Communication functions, including data and voice communications, are performed through the communications subsystem 1001, and possibly through the short-range communications subsystem 1020. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TACT™ or General Packet Radio Service (GPRS) mobile data communications networks, and also designed to operate with any of a variety of voice communications networks, such as Advanced Mobile Phone System (AMPS), time division multiple access (TDMA), code division multiple access (CDMA), Wideband code division multiple access (W-CDMA), personal communications service (PCS), GSM (Global System for Mobile Communications), enhanced data rates for GSM evolution (EDGE), etc. Other types of data and voice networks, both separate and integrated, may also be utilized with the mobile device 1000. The mobile device 1000 may also be compliant with other communications standards such as 3GSM, 3rd Generation Partnership Project (3GPP), Universal Mobile Telecommunications System (UMTS), 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore typically involves use of a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device may also be used to compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, a Bluetooth™ communications module to provide for communication with similarly-enabled systems and devices, or a NFC sensor for communicating with a NFC device or NFC tag via NFC communications.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:
a housing; and
circuitry carried by said housing and comprising
a wireless transceiver,
a wireless broadcast receiver,
audio circuitry coupled to said wireless transceiver and said wireless broadcast receiver,
a wired headset jack, and
a reference voltage device line, and at least one wired headset device line coupled between said audio circuitry and said wired headset jack;
said reference voltage device line also coupled to said wireless broadcast receiver so that a corresponding unshielded reference voltage headset line of a wired headset serves as an antenna for said wireless broadcast receiver.

2. The mobile wireless communications device of claim 1 wherein the wired headset is coupled to said wired headset jack and comprises a plurality of contacts, and a plurality of headset lines respectively coupled to said plurality of contacts.

3. The mobile wireless communications device of claim 2 wherein said plurality of contacts comprises a reference voltage contact, and at least one wired headset line contact; and wherein said plurality of headset lines includes the unshielded reference voltage headset line coupled to said reference voltage contact, and at least one wired headset audio line coupled to said at least one headset line device contact.

4. The mobile wireless communications device of claim 3 wherein said circuitry is configured to determine the reference voltage contact and to selectively couple said reference voltage device line to said reference voltage contact.

5. The mobile wireless communications device of claim 3 wherein said circuitry is configured to determine said at least one wired headset line contact and to selectively couple said at least one wired headset device line to said at least one wired headset contact.

6. The mobile wireless communications device of claim 3 wherein the wired headset comprises an audio input transducer, and an audio output transducer configured to provide audio input and output for said audio circuitry.

7. The mobile wireless communications device of claim 6 wherein said at least one wired headset audio line comprises a plurality thereof comprising an input transducer signal line coupled to said input transducer, and an output transducer line coupled to said output transducer.

8. The mobile wireless communications device of claim 3 wherein said at least one wired headset audio line comprises a plurality thereof comprising stereo audio channel lines.

9. The mobile wireless communications device of claim 1 wherein said wireless broadcast receiver comprises at least one of a frequency modulation (FM) radio receiver and an amplitude modulation (AM) radio receiver.

10. The mobile wireless communications device of claim 1 wherein said wireless transceiver comprises a cellular transceiver.

11. A mobile wireless communications device comprising:
a housing;
circuitry carried by said housing and comprising
a wireless cellular transceiver,
a wireless broadcast receiver,
audio circuitry coupled to said wireless transceiver and said wireless broadcast receiver,
a wired headset jack, and
a reference voltage device line, and at least one wired headset device line coupled between said audio circuitry and said wired headset jack; and
a wired headset to be coupled to said wired headset jack and comprising a plurality of contacts, and a plurality of headset lines respectively coupled to said plurality of contacts, said plurality of headset lines comprising an unshielded reference voltage headset line;
said reference voltage device line also coupled to said wireless broadcast receiver so that said unshielded reference voltage headset line serves as an antenna for said wireless broadcast receiver.

12. The mobile wireless communications device of claim 11 wherein said plurality of contacts comprises a reference voltage contact, and at least one wired headset line contact; wherein said unshielded reference voltage headset line is coupled to said reference voltage contact; and wherein said plurality of headset lines includes at least one wired headset audio line coupled to said at least one headset line contact.

13. The mobile wireless communications device of claim 12 wherein said circuitry is configured to determine the reference voltage contact and to selectively couple said reference voltage device line to said reference voltage contact.

14. The mobile wireless communications device of claim 12 wherein said circuitry is configured to determine said at least one wired headset line contact and to selectively couple said at least one wired headset device line to said at least one wired headset contact.

15. The mobile wireless communications device of claim 12 wherein the wired headset comprises an audio input transducer, and an audio output transducer configured to provide audio input and output for said audio circuitry.

16. The mobile wireless communications device of claim 15 wherein said at least one wired headset audio line comprises a plurality thereof comprising an input transducer signal line coupled to said input transducer, and an output transducer line coupled to said output transducer.

17. The mobile wireless communications device of claim 12 wherein said at least one wired headset audio line comprises a plurality thereof comprising stereo audio channel lines.

18. The mobile wireless communications device of claim 11 wherein said wireless broadcast receiver comprises at least one of a frequency modulation (FM) radio receiver and an amplitude modulation (AM) radio receiver.

19. A method for making a mobile wireless communications device comprising:

providing a housing;

coupling circuitry to be carried by the housing and comprising a wireless transceiver, a wireless broadcast receiver, audio circuitry coupled to the wireless transceiver and the wireless broadcast receiver, a wired headset jack, and a reference voltage device line, and at least one wired headset device line coupled between the audio circuitry and the wired headset jack; and coupling the reference voltage device line to the wireless broadcast receiver so that a corresponding unshielded reference voltage headset line of a wired headset serves as an antenna for the wireless broadcast receiver.

20. The method of claim 19 further comprising providing the wired headset to be coupled to the wired headset jack, the wired headset comprising a plurality of contacts, and a plurality of headset lines respectively coupled to the plurality of contacts.

21. The method of claim 20 wherein the plurality of contacts comprises a reference voltage contact, and at least one wired headset line contact; and wherein the plurality of headset lines includes the unshielded reference voltage headset line coupled to the reference voltage contact, and at least one wired headset audio line coupled to the at least one headset line contact.

22. The method of claim 21 further comprising configuring the circuitry to determine the reference voltage contact and to selectively couple the reference voltage device line to the reference voltage contact.

23. The method of claim 21 further comprising configuring the circuitry to determine the at least one wired headset line contact and to selectively couple the at least one wired headset device line to the at least one wired headset contact.

24. A method of operating a mobile wireless communications device comprising a wireless transceiver, a wireless broadcast receiver, audio circuitry coupled to the wireless transceiver and the wireless broadcast receiver, a wired headset jack to be coupled to a wired headset, and a reference voltage device line coupled to the wireless broadcast receiver, and at least one wired headset device line coupled between the audio circuitry and the wired headset jack, the wired headset comprising a reference voltage contact, the method comprising:

determining the reference voltage contact and selectively coupling the reference voltage device line to the reference voltage contact so that a corresponding unshielded reference voltage headset line of the wired headset serves as an antenna for the wireless broadcast receiver.

25. The method of claim 24 wherein the wired headset comprises a plurality of contacts including the reference voltage contact, and a plurality of headset lines respectively coupled to the plurality of contacts.

26. The method of claim 25 wherein the plurality of contacts comprises at least one wired headset line contact; and wherein the plurality of headset lines includes the unshielded reference voltage headset line coupled to the reference voltage contact, and at least one wired headset audio line coupled to the at least one headset line device contact.

27. The method of claim 26 further comprising determining the at least one wired headset line contact and selectively coupling the at least one wired headset device line to the at least one wired headset contact.

28. The method of claim 26 wherein the wired headset comprises an audio input transducer, and an audio output transducer configured to provide audio input and output for the audio circuitry.

29. The method of claim 26 wherein the at least one wired headset audio line comprises a plurality thereof comprising an input transducer signal line coupled to the input transducer, and an output transducer line coupled to the output transducer.

30. The method of claim 26 wherein the at least one wired headset audio line comprises a plurality thereof comprising stereo audio channel lines.

* * * * *